US006276015B1

(12) United States Patent
Cook

(10) Patent No.: US 6,276,015 B1
(45) Date of Patent: Aug. 21, 2001

(54) METHOD OF CLEANING A SOILED SURFACE

(75) Inventor: James E. Cook, Anoka, MN (US)

(73) Assignee: Pure Rinse Systems, Inc., Anoka, MN (US)

( * ) Notice: Subject to any disclaimer, the term of this patent is extended or adjusted under 35 U.S.C. 154(b) by 0 days.

(21) Appl. No.: 09/393,784

(22) Filed: Sep. 10, 1999

(51) Int. Cl.[7] ..... B08B 3/00
(52) U.S. Cl. ..... 8/158
(58) Field of Search ..... 8/158, 137; 15/321

(56) References Cited

U.S. PATENT DOCUMENTS 3,883,301 * 5/1975 Emrick et al. ..... 8/158
3,909,197 * 9/1975 Cremers ..... 8/158
4,154,578 * 5/1979 Bane ..... 8/158 X

* cited by examiner

*Primary Examiner*—Philip R. Coe
(74) *Attorney, Agent, or Firm*—Roger W. Jensen

(57) ABSTRACT

A method of cleaning a soiled carpet by first prespraying the carpet with a preselected liquid chemical sprayed through a nozzle at a preselected specific pressure/flow rate to obtain an optimized spray droplet size which penetrates deep into the carpet while utilizing only a minimum volume of chemical solution and preventing overwetting of the carpet. After the prespray chemical has had sufficient time to chemically react with soil in the carpet, then the carpet is rinsed with pure water. The final step in the process is the extracting, by use of a vacuum, the prespray chemical and pure water from the carpet.

5 Claims, 1 Drawing Sheet

METHOD OF CLEANING A SOILED SURFACE

BACKGROUND OF THE INVENTION

The field of the present invention is a method of cleaning a soiled surface such as fabric or a carpet. There have been, of course, many prior art techniques, processes and products for cleaning fabrics and carpets, all of which have one or more disadvantages.

One prior art method of cleaning carpets, which is in widespread use, involves the use of a detergent-saturated solution being sprayed onto the carpet, following which it is vacuumed and allowed to dry. The result is something that may look clean but in actuality is sticky, stiff and waiting (like flypaper) to attract the next available particle of soil. Furthermore, the volatile solvents in the cleaning chemicals, as they dry, fill the air of the building in which they were used causing eye, nasal and lung irritation. After the cleaning solution dries, then the residual chemical and mineral precipitate (solids) flake off and become airborne, like cat dander, and further irritate eyes, nose, lungs and skin. The aforesaid volatile solvents and residual chemical and mineral precipitate may trigger allergies, asthma attacks and other sinus and respiratory problem.

The prior art prespray of chemical has been applied by the use of hand-squeeze bottle, hand pump-up sprayers, or handheld low-pressure injection systems. All of these methods apply a mist of chemical to the very top surface of the carpet. If the soil is deep into the carpet, then the carpet needs to be soaked with the prespray chemical; the aforesaid soaking actually causes the soil to migrate deeper into the carpet. Thus, the experience with the prior art carpet cleaning process is that a carpet, once cleaned, needs to be cleaned more often. Also, fumes or a strong smell lingering for a period of time after the carpets are cleaned is typical. The "cleaned" carpet will feel stiff and is easily matted in traffic areas. Stains, believed to have been removed, reappear a short time later. A universal recommendation to friends and family, by those who have had their carpets cleaned, is to wait as long as possible before you have the carpets cleaned for the first time, because you then will need to have them cleaned frequently thereafter.

SUMMARY OF THE INVENTION

The present invention eliminates the above-mentioned problems with the prior art system, and does so using 50 to 90% less chemical. In broad terms, the present invention provides a fabric and rug cleaning process comprising four steps. First, there is a unique method of preapplication of cleaning chemicals. Second, there is allowance of a dwell-time for enzyme or other natural cleaning agents to digest and emulsify soil in the carpet. Next, there is a rinse of the carpet with pure $H_2O$ molecules to remove or strip the chemical residue and minerals. Finally, the cleaning chemical, emulsified dirt and water are extracted. The result is a cleaner, softer surface that stays clean longer, in addition to providing a much safer and healthier indoor environment.

More specifically, the present invention provides a method of cleaning a soiled surface, such as a soiled carpet, comprising four steps. The first step is to pre-spray the soiled carpet with a preselected liquid prespray chemical, sprayed through a nozzle at specific pressure/flow rate so as obtain an optimum spray droplet size which penetrates deep into the carpet with only a minimized volume of spray utilized or consumed, and avoiding saturation or overwetting of the carpet. The prespray chemical is allowed to chemically react with the soil in the carpet for a dwell time, following which the carpet is rinsed with pure water, such as water provided by a reverse osmosis apparatus. Finally, the pre-spray chemical and pure water are extracted from the carpet.

The most important and unique step in the above-described cleaning process is to use $H_2O$ molecules, sometimes referred to as a universal solvent, to rinse the carpet or other soiled surface. This invention is more profound than the "dry-cleaning" process introduced decades ago, since it is also a solvent process, but with a total, natural purity. In contrast to tap water, and even so-called "soft water", "pure water" obtained as a reverse-osmosis product, contains almost no minerals or other non-pure elements.

BRIEF DESCRIPTION OF THE DRAWING

The single

DETAILED DESCRIPTION OF THE INVENTION

Figure 1:
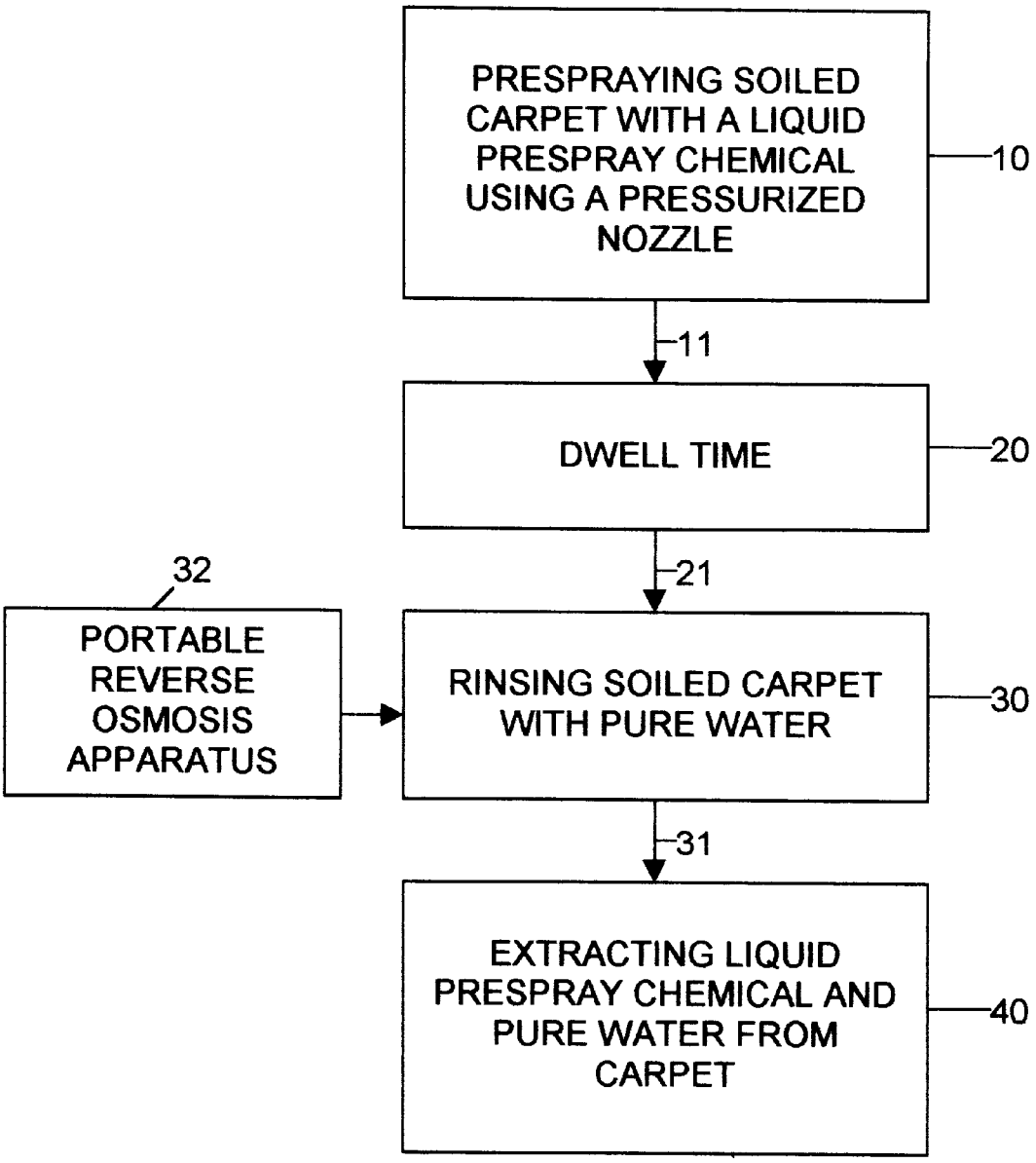
FIG. 1 shows a block diagram of the unique cleaning process of this invention.

Referring to the FIGURE, the first step in my unique process is a block 10 specifying the prespraying of a soiled carpet with a liquid prespray chemical using a pressurized nozzle. One apparatus that is very satisfactory for this step of the process is the Penetrator™ 200 PSI Prespray Unit, manufactured and sold by Pure Rinse Systems, Inc. of Anoka, Minn.

The liquid prespray chemical is preferably a natural enzyme such as Organic Stain PreSpray sold by Pure Rinse Systems, Inc.

The pressure and flow combination or rate through a spray nozzle for applying the prespray chemical is extremely important so as to obtain the optimum droplet size. For example, imagine 1000 psi at 1/10th gpm of flow; this would product a very small droplet size, like a fog. On the other hand, imagine 10 psi at 1 gpm. This would be like the flow of water through a garden hose, i.e., a very large droplet. Obviously, neither of the foregoing droplet sizes would be desirable to apply prespray chemicals to the carpet. Optimal droplet size occurs at a nozzle velocity where each gallon of flow is matched with a range of pressure between 300–400 psi. In the preferred embodiment of the invention, a proportional flow/pressure of 0.66 (2/3) gpm at 200 psi is selected (2/3 or 300 psi=200 psi).

The next step in the process is dwell time, represented in the FIGURE by block 20, lined by arrow 11 to block 10; this term is used to describe the time for a chemical reaction to take place. Generally, as temperature modestly increases, the dwell time decreases. However, if the ambient temperature is too high, then the dwell time will be increased or, in extreme cases, stop the chemical reaction altogether. Modem organic stain chemicals are enzymes which actually "digest" organic stains. Temperatures above 140° F. begin to kill the enzymes. Enzymes continue to clean, i.e., digest, as long as they are still moist. When they dry out, they die. Typical dwell time is 1–10 minutes, depending on soil condition and temperature.

The penetrating prespray procedure is the best method for applying enzyme or other chemicals. Penetration of the enzyme chemical through the surface or nap of the carpet and deep into the stain facilitates the maximum deep cleaning results.

The next step in the cleaning process is block 30 connected by arrow 21 to block 20 as shown in the FIGURE, i.e., rinsing the soiled carpet with pure water. Pure $H_2O$ molecules possess both positive and negative charges, and are a very aggressive solvent; hence the frequent designator "a universal solvent". "Regular" water, on the other hand, whether from the tap, spring, or water softener, has many, or perhaps most of its positive and negative charges, already taken by minerals in the water. Pure water obtained from a reverse osmosis apparatus has almost no mineral content; "almost" is like 190 proof alcohol—200 proof is impossible since moisture in the air is absorbed. In the case of pure water, any element in any container or conduit is absorbed. The use of pure water permits the use of very significantly less (50–90%) chemical; this is because there is no water hardness to overcome, and pure water on its own penetrates and permeates deep into soiled surfaces due to reduced surface tension of pure water. In addition, pure water dissolves residual mineral deposits already in the carpet or fabric (pet urine, for example), and removes residual harsh chemicals from prior cleanings. In some cases, a pure water ringing of the carpet is all that is needed to clean carpets that have been cleaned improperly (overly saturated with chemical, for example). The removal of residual chemicals and minerals is all that is required to restore the carpet to a like-new condition in terms of feel, aroma and cleanliness.

An apparatus that may be used for providing the pure water for the cleaning process is a portable reverse osmosis apparatus (identified by reference numeral 32 in the FIGURE) and marketing by the above-mentioned Pure Rinse Systems, Inc. as the R.O.bot™.

The actual rinsing of the soiled carpet with pure water can be done using any suitable apparatus commonly referred to as a carpet soil extractor. In the preferred embodiment of the invention is used a combination pump and vacuum sold by Century 400, 31965 United Avenue, Pueblo, Colo., under the tradename NINJA™. The rinsing is done with the same proportional pressure and flow rate principle as the above-described liquid prespray chemical; the NINJA™ uses 1 gpm at 400 psi.

The final step of the process is identified by reference numeral 40 in the FIGURE, being connected to block 30 by arrow 31. The final step in the process is the vacuum extracting of liquid prespray chemical and pure water from the carpet. In the preferred embodiment of the invention, I use the above-mentioned NINJA™ combination pump and vacuum unit. It is important to have sufficient suction force provided by the vacuum so as to remove the prespray chemical and pure water, and associated soil from the carpet. The results of the process are outstanding and long lasting in comparison to prior art cleaning methods.

While the preferred embodiment of the invention has been illustrated, it will be understood that variations may be made by those skilled in the art without departing from the inventive concept. Accordingly, the invention is to be limited only by the scope of the following claims.

What is claimed is:

1. A method of cleaning a soiled carpet comprising the steps of:

a. prespraying said carpet with a preselected liquid chemical through a nozzle at specific pressure/flow rates to obtain a spray droplet size which penetrates deep into said carpet with minimized volume of liquid chemical;

b. allowing a dwell time to permit said prespray chemical to chemically react with soil in said carpet;

c. rinsing said carpet with pure water; and d. extracting said prespray liquid chemical and said soil as entrained by said pure water from said carpet.

2. The method of claim 1 wherein said droplet size is optimized at a prespraying proportional pressure/flow rate of 300–400 psi for each gallon of flow.

3. The method of claim 1 wherein said prespray chemical is an enzyme cleaning chemical.

4. The method of claim 1 wherein said extracting of prespray chemical and pure water also extracts and removes from said carpet chemically emulsified soil, and residual chemicals and minerals.

5. The method of claim 1 wherein said pure water is obtained from a portable reverse osmosis apparatus.

* * * * *